US008267716B2

(12) United States Patent
Wu

(10) Patent No.: US 8,267,716 B2
(45) Date of Patent: Sep. 18, 2012

(54) CABLE ASSEMBLY WITH FERRULE

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 180 days.

(21) Appl. No.: 12/876,234

(22) Filed: Sep. 6, 2010

(65) Prior Publication Data

US 2011/0059645 A1 Mar. 10, 2011

(30) Foreign Application Priority Data

Sep. 7, 2009 (CN) ..... 200920309733

(51) Int. Cl.
*H01R 13/58* (2006.01)

(52) U.S. Cl. ..... 439/455; 439/942

(58) Field of Classification Search ..... 439/455, 439/607.41, 607.47, 607.48
See application file for complete search history.

(56) References Cited

U.S. PATENT DOCUMENTS 4,592,612 A * 6/1986 Kikuta ..... 439/607.47
4,641,906 A * 2/1987 Olsson ..... 439/465
4,891,022 A * 1/1990 Chandler et al. ..... 439/607.51
4,990,094 A * 2/1991 Chandler et al. ..... 439/108
5,052,949 A * 10/1991 Lopata et al. ..... 439/607.45
7,354,292 B1 4/2008 Lloyd
7,798,843 B1 * 9/2010 Wu ..... 439/455

* cited by examiner

*Primary Examiner* — Neil Abrams
(74) *Attorney, Agent, or Firm* — Wei Te Chung; Andrew C. Cheng; Ming Chieh Chang

(57) ABSTRACT

An cable assembly includes an external cover having a back wall defining a retaining cavity; at least one printed circuit board accommodated in the external cover; two cables arranged in juxtaposed manner, each cable including a number of wires, a shielding layer shrouding the wires, a metallic braiding enclosing the shielding layer and an insulative jacket enclosing the metallic braiding; two ring shaped reinforcement members, each reinforcement member located between the shielding layer and the metallic braiding of a front segment of the each cable; and a ferrule crimped to the front segments of the two cable and encircling the reinforcement members, the ferrule retained in the retaining cavity, and the metallic braiding of each cable sandwiched between the ferrule and the reinforcement member inside the corresponding cable.

17 Claims, 6 Drawing Sheets

CABLE ASSEMBLY WITH FERRULE

FIELD OF THE INVENTION

The present invention generally relates to a cable assembly, and more particularly to a cable assembly with a ferrule.

DESCRIPTION OF PRIOR ART

U.S. Pat. No. 7,354,292 issued on Apr. 8, 2008 to Lloyd discloses a cable assembly for high-speed transmitting. The cable assembly includes an upper cover and a lower cover, a printed circuit board accommodated therein, and a cable connected to the printed circuit board. The upper cover and the lower cover define two semi-circular shaped cable outlets at rear sides thereof. When the upper cover and the lower cover are assembled together, the cable is held in the cable outlets, therefore the cable is not separated from the printed circuit board easily.

With transmitting speed increased, more wires inside of the cable are required, some protecting precautions are required. For example, there is a metallic foil inside the cable for shielding the wires therein. While the cable is secured in the cable outlets of the covers, enough retaining force is needed to ensure reliable mechanical connection between the covers and the cable. However, an inner structure of the cable may be damaged if the cable deformed excessively.

Hence, an improved cable assembly is highly desired to overcome the aforementioned problems.

SUMMARY OF THE INVENTION

Accordingly, an object of the present invention is to provide a lower profile cable assembly having protecting structure thereof.

In order to achieve the object set forth, a cable assembly in accordance with the present invention comprises an external cover having a back wall defining a retaining cavity; at least one printed circuit board accommodated in the external cover; two cables arranged in juxtaposed manner, each cable including a number of wires, a shielding layer shrouding the wires, a metallic braiding enclosing the shielding layer and an insulative jacket enclosing the metallic braiding; two ring shaped reinforcement members, each reinforcement member located between the shielding layer and the metallic braiding of a front segment of the each cable; and a ferrule crimped to the front segments of the two cable and encircling the reinforcement members, the ferrule retained in the retaining cavity, and the metallic braiding of each cable sandwiched between the ferrule and the reinforcement member inside the corresponding cable.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
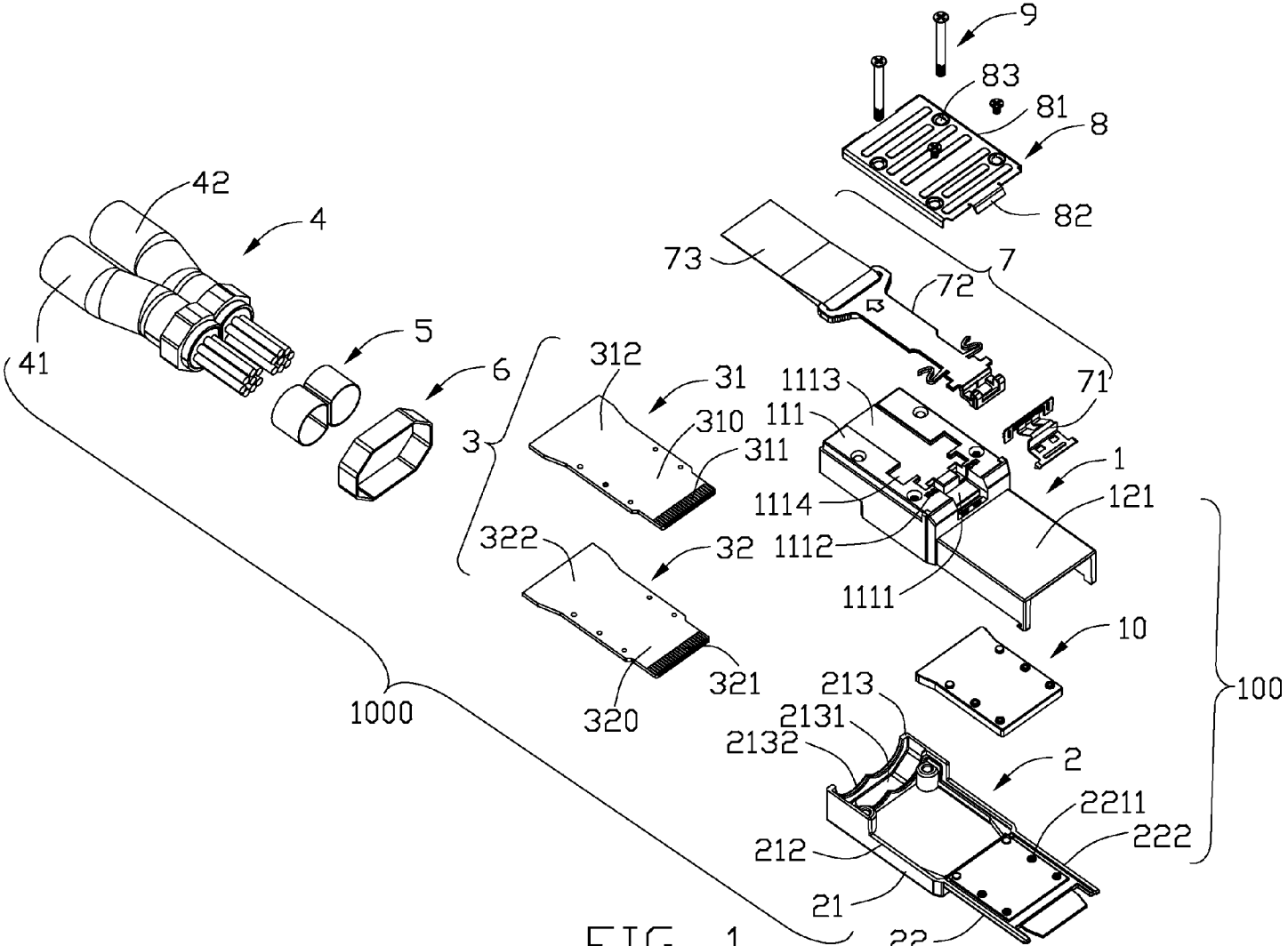
FIG. 1 is an exploded, perspective view of a cable assembly in accordance with the present invention.
Figure 2:
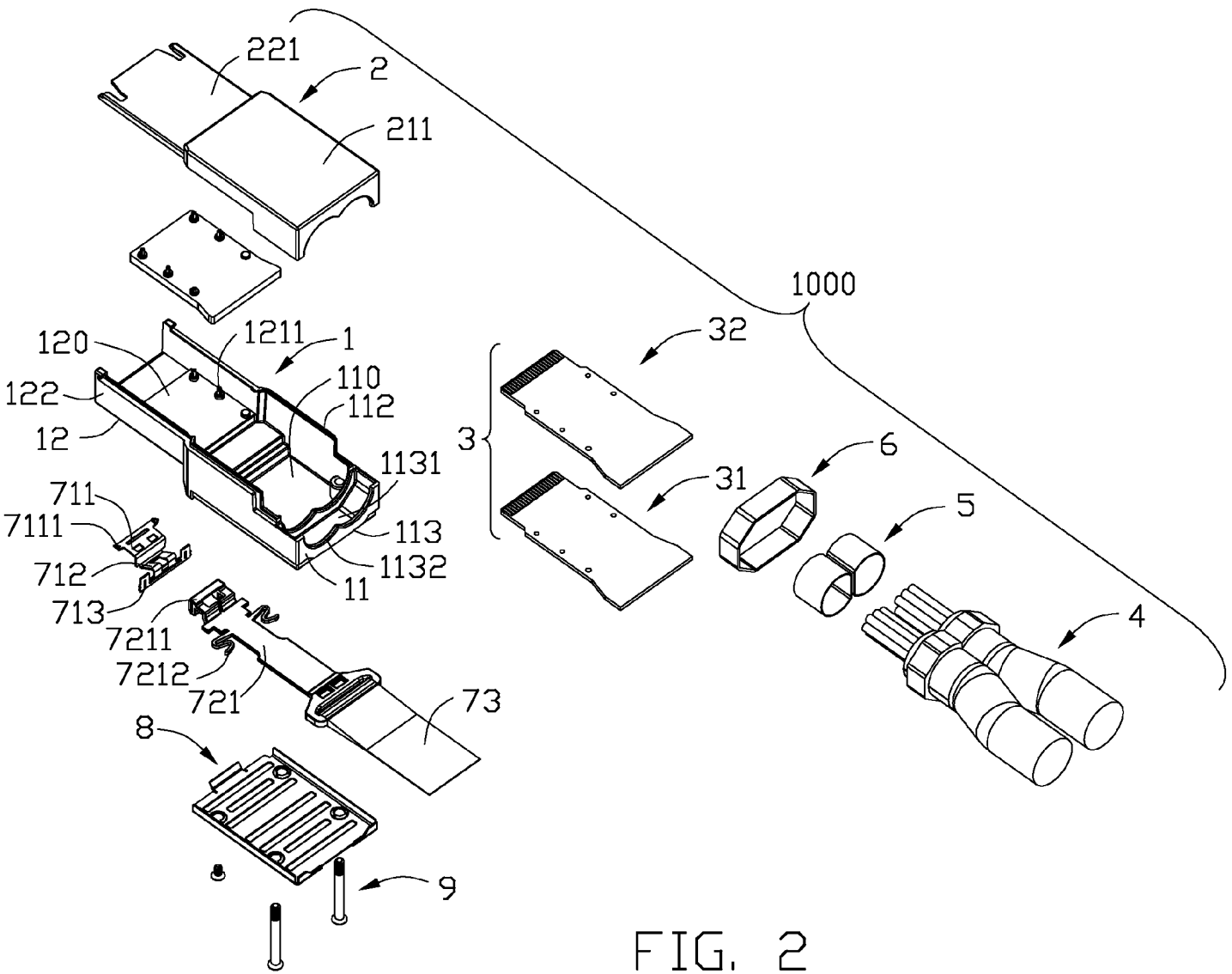
FIG. 2 is similar to FIG. 1, but viewed from another aspect.
Figure 3:
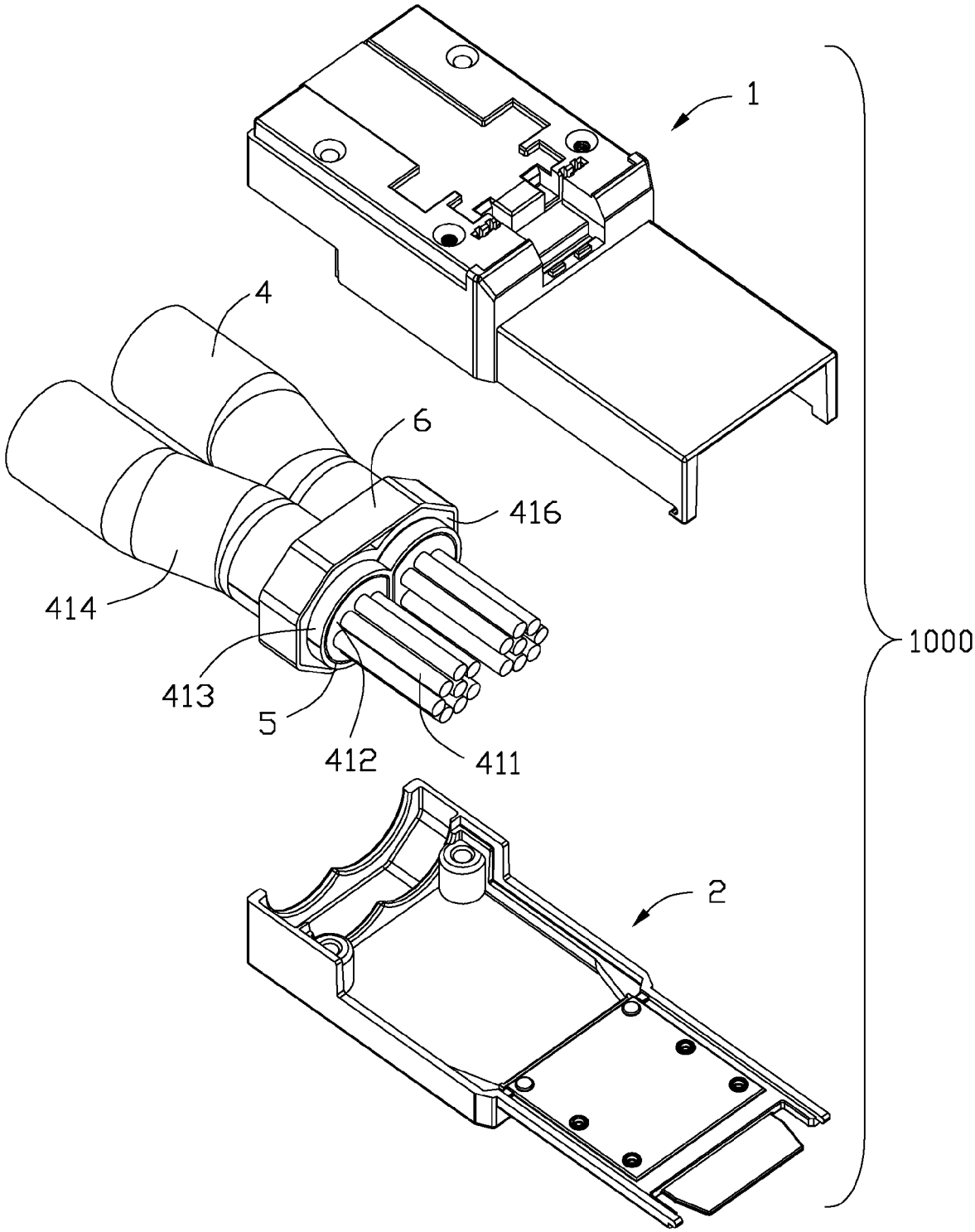
FIG. 3 is a partially assembled view of the cable assembly.
Figure 4:
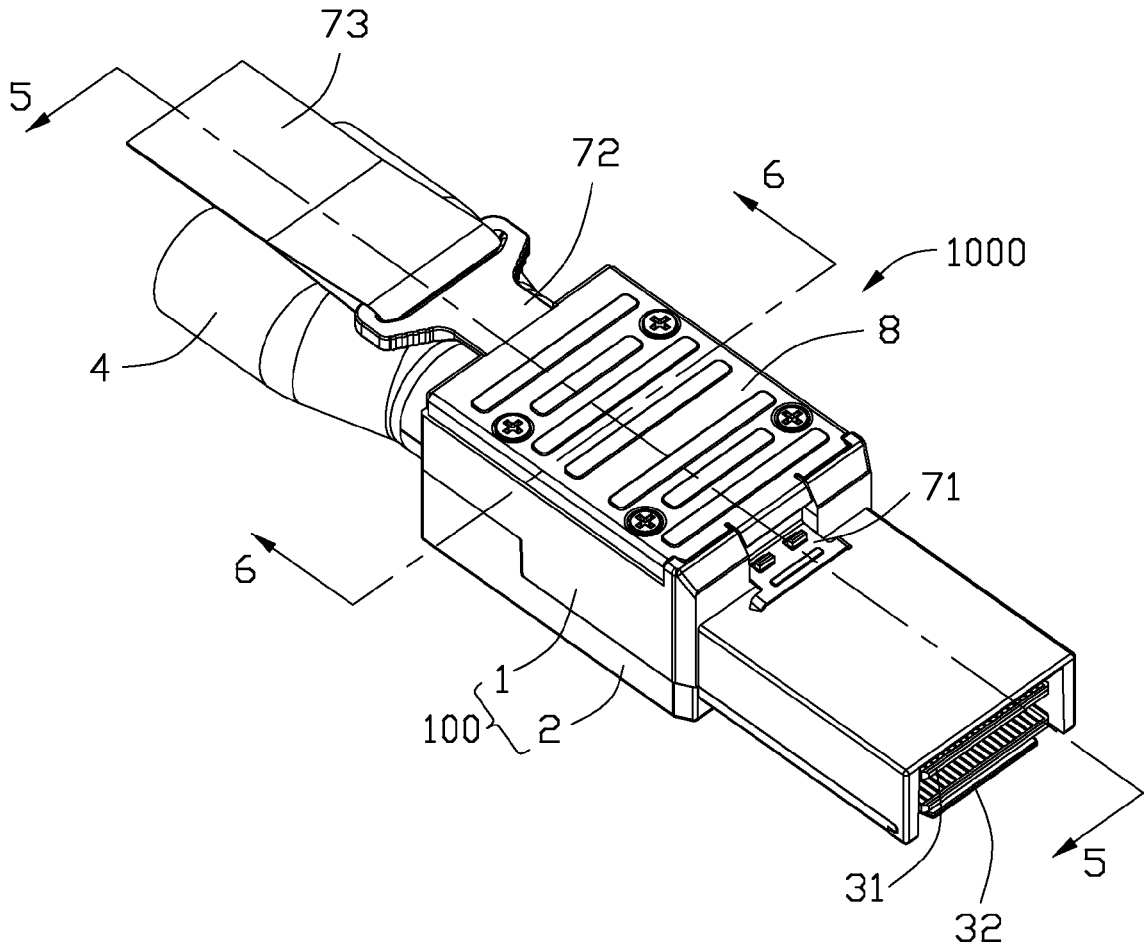
FIG. 4 is an assembled, perspective view of the cable assembly.
Figure 5:
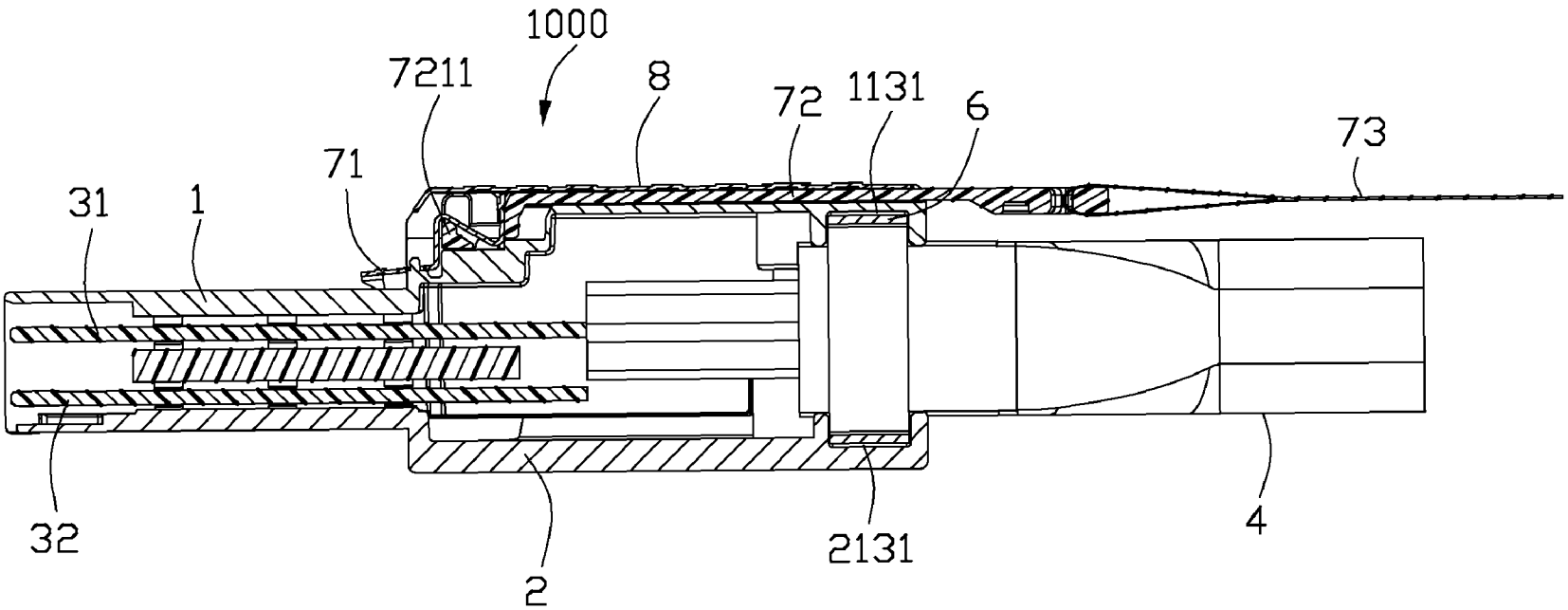
FIG. 5 is a cross-section view taken along line 5-5 of FIG. 4.
Figure 6:
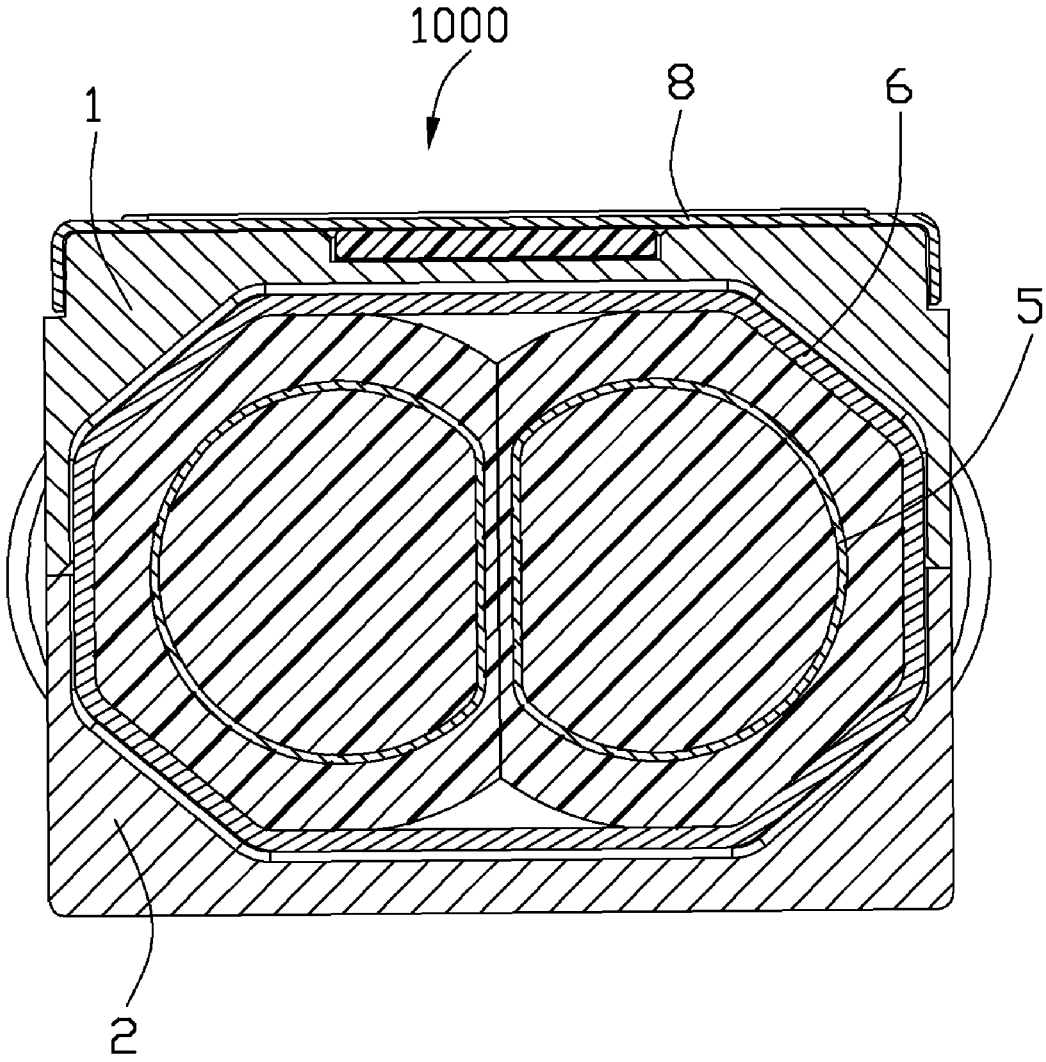
FIG. 6 is a cross-section view taken along line 6-6 of FIG. 4.

Referring to FIGS. 1-6, a cable assembly 1000 in accordance with the present invention comprises an external cover 100, two printed circuit boards 3 accommodated in the external cover 100, two cables 4 respectively connected to the two printed circuit boards 3, a reinforcement member 5 mounted to a front segment of each cable 4, a ferrule 6 bundling the two cables 4, a latching mechanism 7 assembled to the external cover 100, a cap 8 shielding the latching mechanism 7 and four screws 9.

The external cover 100 includes a first cover 1 and a second cover 2 combined together. The first cover 1 and the second cover 2 are made of metallic materials.

The first cover 1 has a base portion 11 and a mating portion 12 extending forwardly from the base portion 11. The base portion 11 has a top wall 111, two lateral walls 112 downwardly projecting from lateral edges of the top wall 111, and a back wall 113 downwardly projecting from a rear edge of the top wall 111. The top wall 111 and the two lateral walls 112 and the back wall 113 together form a first hollow 110. There is a retaining cavity 1131 defined in a middle segment of the back wall 113 and two outlets 1132 are defined in a front and a back segments of the back wall 113. The two outlets 1132 communicate with the retaining cavity 1131. The mating portion 12 has an upper wall 121 and two side walls 122 extending downwardly from lateral edges of the upper wall 121. The upper wall 121 and two side walls 122 together form a second hollow 120. The first hollow 110 and the second hollow 120 communicate with each other. The first hollow 110 is larger than the second hollow 120. In addition, there are several positioning posts 1211 located inside the second hollow 120. A recess 1111 is defined in a front segment of an outer side of the top wall 111. A channel 1113 is defined in a back segment of the outer side of the top wall 111. The channel 1113 communicates with the recess 1111. There is a slit 1112 located in the front segment of the outer side of the top wall 111 and behind the recess 1111. The slit 1112 communicates with the recess 1111. There are two grooves 1114 located in two sides of a front portion of the channel 1113 and communicate with the channel 1113.

The second cover 2 includes a main portion 21 and a tongue portion 22 extending forwardly from the main portion 21. The main portion 21 has a bottom wall 211 and two flanges 212 formed at lateral sides of the bottom wall 211. In addition, there is also a back wall 213 upwardly protruding from rear side of the bottom wall 211. There is a retaining cavity 2131 defined in a middle segment of the back wall 213 and two outlets 2132 are defined in a front and a back segments of the back wall 113. In addition, there are two protrusions 222 formed at each lateral edge of the tongue portions 22. Several standoffs 2211 are located on the tongue portion 22 and located aside the two protrusions 222.

The printed circuit boards 3 includes a first printed circuit board (PCB) 31 and a second PCB 32. There are several first conductive pads 311 formed on a front segment 310 of the first PCB 31, and there are also several second conductive pads 321 formed on a front segment of the second PCB 32. The first PCB 31 and the second PCB 32 are mounted into the first cover 1, with the front segments 310, 320 located in the second hollow 120, while rear segments 312, 322 of the first and second PCBs 31, 32 located in the first hollow 110.

The cable 4 include a first cable 41 and a second cable 42 arranged in juxtaposed manner. The first cable 41 includes a number of wires 411, a shielding layer 412 shrouding the wires 411, a metallic braiding 413 enclosing the shielding layer 412 and an insulative jacket 414 enclosing the metallic braiding 413. The shielding layer 412 can be aluminum foil and other similar structure. The second cable 42 is similar to the first cable 41, and detailed structure of the second cable 42 is omitted hereby. The wires 411 of the first cable 41 and the second cable 42 are soldered to the rear segments 312, 322 of the first PCB 31 and the second PCB 32. In addition, there is a spacer 10 disposed between the first PCB 31 and the second PCB 32 so as to separate them from each other along a un-to-down direction.

The reinforcement member 5 is a pipe or ring shaped member, which is made of metallic material or other hard materials. Each reinforcement member 5 has a passage (not numbered) extending along axially direction thereof. The reinforcement member 5 is mounted to an outside of the shielding member 412, inside of the metallic braiding 413 of a front segment of either the first cable 41 or the second cable 42. The wires 411 pass through the reinforcement member 5.

The ferrule 6 is also a ring/loop shaped member which is made of metallic material mounted to the front segments of the first cable 41 and the second cable 42. A partial of metallic braiding 413 is backed over an outside of the insulative jacket 414 of the front segment of the first cable 41 or the second cable 42, and a conductive tape 416 is attached to the partial of the metallic braiding 413, and the ferrule 6 is crimped to the conductive tape 416 and the partial of the metallic braiding 413. In addition, the ferrule 6 further encircles the reinforcement members 5, therefore the first cable 41 and the second cable 42 are bundled together. There is a portion of the each reinforcement member 5 which is located between two passages of the two reinforcement member is deformed inwardly. Accordingly, partial of the metallic braiding 413 of the first cable 41 and partial of the metallic braiding of the second cable 42 which are arranged adjacent to each other and sandwiched between the portions of the two reinforcement members 5. The reinforcement members 5 are used for preventing shielding layer 412 and the wires 411 from being destroyed or deformed excessively. The metallic braiding 413 is sandwiched between the reinforcement member 5 and the ferrule 6. The ferrule 6 is retained in retaining cavities 1131, 2131 of the back walls 113, 213. Therefore, the cable 4 is connected to the external cover 100 reliably. In addition, the metallic braiding 413, the conductive tape 416, the ferrule 6 and the external cover 100 form a grounding line.

The latching mechanism 7 includes a latching member 71, an actuating member 72 and a pulling tape 73.

The latching member 71 has a L-shaped main portion 711, an engaging portion 713 and an inclined connecting portion 712 linking the main portion 711 and the engaging portion 713. Two hooks 7111 are formed at lateral sides of the main portion 711, respectively. The engaging portion 713 is located in a vertical plane. The actuating member 73 includes a stretched body portion 721, an actuating portion 7211 formed at a front end thereof, two elastic portions 7212 formed at lateral sides of a front segment of the actuating portion 7211. The pull tape 73 is attached to a back segment of the actuating portion 7211.

The actuating member 72 is mounted to the first cover 1, with the body portion 721 accommodated in the channel 1113 and capable of sliding therein along a front-to-back direction, the actuating portion 7211 accommodated in the recess 7111, the engaging portion 713 interferentially assembled into the slit 1112. The connecting portion 712 is disposed above the actuating portion 7211.

The cap 8 includes a main part 81, a tab 82 protruding downwardly and forwardly from a front edge of the main part 81. There are four holes 83 defined in the main port 81. The cap 8 is mounted to the base portion 11 of the first cover 1 to shield the actuating member 72 and the latching member 71. In addition, the tab 82 is located above the main portion 711 of the latching member 71. The screws 9 are assembled to the first cover 1 and the second cover 2 via holes 83 defined in the cap 8.

When the cable assembly 1000 mating with a complementary connector (not shown), the hooks 7111 of the latching member 71 locking into latching holes (not shown) of the complementary connector, therefore the cable assembly 1000 and the complementary connector can securely combined together. When separating the cable assembly 1000 from the complementary connector, just exerting a pulling force to the pulling member 73 to rearwardly move the actuating member 72, and the actuating portion 7211 slides along the connecting portion 712 to bring it flip upwardly. Therefore, the hooks 7111 detach from latching holes of the complementary connector. The elastic portions 7212 can provide a restore force to push the actuating member 72 to its original position. The tab 82 can urge the latching portion 71 to its original position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an external cover having a back wall defining a retaining cavity;

at least one printed circuit board accommodated in the external cover;

two cables arranged in juxtaposed manner, each cable including a number of wires, a shielding layer shrouding the wires, a metallic braiding enclosing the shielding layer and an insulative jacket enclosing the metallic braiding;

two ring shaped reinforcement members, each reinforcement member located between the shielding layer and the metallic braiding of a front segment of the each cable; and a ferrule crimped to the front segments of the two cables and encircling the reinforcement members, the ferrule retained in the retaining cavity, and the metallic braiding of each cable sandwiched between the ferrule and the reinforcement member inside the corresponding cable.

2. The cable assembly as recited in claim 1, wherein there is a portion of each reinforcement member deformed inwardly.

3. The cable assembly as recited in claim 2, wherein the portion of each reinforcement member is located between two passages of the two reinforcement members.

4. The cable assembly as recited in claim 1, wherein a partial of the metallic braiding is backed over an outside of the insulative jacket, and the ferrule is crimped to the partial of the metallic braiding.

5. The cable assembly as recited in claim 4, wherein the external cover is made of metallic material.

6. The cable assembly as recited in claim 1, wherein the external cover includes a first cover and a second cover assembled together.

7. The cable assembly as recited in claim 6, wherein the retaining cavity is defined in back walls of the first cover and the second cover.

8. The cable assembly as recited in claim 7, wherein there are two outlets defined in the back walls of the first cover and the second cover, the two cables extend into the external cover via the two outlets.

9. The cable assembly as recited in claim 8, wherein the retaining cavity is defined in a middle segment of the back wall, and the outlets are defined in a front and back segments of the back wall.

10. A cable assembly, comprising:

an external cover having a first cover and a second cover, a retaining cavity defined in at least one back walls of the first cover and the second cover;

two printed circuit boards sandwiched between the first cover and the second cover;

two cables each having a plurality of wires, a metallic braiding enclosing the shielding layer and an insulative jacket enclosing the metallic braiding;

two reinforcement members respectively inserted into front segments of the two cables, the wires of each cable passing through a passage of the corresponding reinforcement member and connecting to one of the two printed circuit boards; and a ferrule mounted to outside of the front segments of the two cable to bundle the two cable together, the metallic braiding of either the first cable or the second cable sandwiched between the corresponding reinforcement member and the ferrule, the ferrule retained in the retaining cavity.

11. The cable assembly as recited in claim 10, wherein there is partial of metallic braiding is backed over an outside of the insulative jacket of each cable, and the ferrule is crimped to the partial of the metallic braiding.

12. The cable assembly as recited in claim 11, wherein there is a conductive tape attached to the partial of the metallic braiding, and the conductive tape is enclosed by the ferrule.

13. The cable assembly as recited in claim 12, wherein there are other portions of the metallic braiding of the two cables arranged adjacent to each other and sandwiched between the two reinforcement members.

14. The cable assembly as recited in claim 12, wherein the metallic braiding, the conductive tape, the ferrule and the external cover together form a grounding line.

15. An electrical cable connector assembly comprising:

an external cover having a back wall defining a retaining cavity;

at least one printed circuit board accommodated in the external cover;

at least a cable including a number of wires, a shielding insulative layer shrouding the wires, a metallic braiding enclosing the shielding layer and an insulative jacket enclosing the metallic braiding;

a ring shaped reinforcement member located between the insulative shielding layer and the metallic braiding of a front segment of the cable; and a ferrule crimped to the front segments of the cable and encircling the jacket and retained in the retaining cavity, and both the metallic braiding and the insulative jacket sandwiched between the ferrule and the reinforcement member inside the cable; wherein the cable is configured with a telescopic shape, at the front segment of the cable, having axially a front small section composed of said wires, a middle median section formed by the shielding insulative layer, the metallic braiding and the reinforcement member radially therebetween, and a rear large section defined by the insulative jacket under condition that the reinforcement member is axially longer than the ferrule with a portion radially overlapped with the reinforcement member.

16. The electrical cable connector assembly as claimed in claim 15, wherein there are two said cables side by side arranged with each other, and there are two rings respectively inserted into the corresponding cables while only one ferrule commonly encloses both said two cable.

17. The electrical cable connector assembly as claimed in claim 16, wherein said two rings defines opposite planar faces facing toward each other.

* * * * *